US005495997A

United States Patent [19]

Moody

[11] Patent Number: 5,495,997

[45] Date of Patent: Mar. 5, 1996

[54] SUPPORT APPARATUS FOR CORELESS TOILET TISSUE ROLL

[75] Inventor: John R. Moody, Antioch, Calif.

[73] Assignee: James River Paper Company, Inc., Richmond, Va.

[21] Appl. No.: 317,398

[22] Filed: Oct. 4, 1994

[51] Int. Cl.[6] ..... B65H 16/06; B65H 19/10

[52] U.S. Cl. ..... 242/561; 242/560; 242/598.3; 242/598.6; 242/599.3; 242/606; 242/613.2

[58] Field of Search ..... 242/598.3, 598.4, 242/598.5, 598.6, 599, 599.3, 599.4, 560, 560.1, 560.2, 560.3, 561, 606, 613.2

[56] References Cited

U.S. PATENT DOCUMENTS

| | | | |
|---|---|---|---|
| D. 312,179 | 11/1990 | De Luca et al. . | |
| D. 335,410 | 5/1993 | Abel et al. . | |
| D. 340,375 | 10/1993 | Hines . | |
| 1,665,738 | 4/1928 | Hoegger | 242/598.4 X |
| 1,825,822 | 10/1931 | Rundell . | |
| 1,890,243 | 12/1932 | Zachert | 242/599.4 X |
| 2,522,109 | 9/1950 | Foltis . | |
| 2,650,773 | 9/1953 | Fanning . | |
| 3,317,099 | 5/1967 | Solomon | 242/598.4 X |
| 3,690,580 | 9/1972 | Jespersen . | |
| 3,771,739 | 11/1973 | Nelson | 242/561 X |
| 3,788,573 | 1/1974 | Thomson et al. . | |
| 4,108,389 | 8/1978 | Womack . | |
| 4,362,278 | 12/1982 | Hopkinson . | |
| 4,671,466 | 6/1987 | Jespersen et al. . | |
| 5,100,075 | 3/1992 | Morand . | |
| 5,277,375 | 1/1994 | Dearwester . | |
| 5,370,336 | 12/1994 | Whittington | 242/560.2 |

*Primary Examiner*—John M. Jillions
*Attorney, Agent, or Firm*—Thomas R. Lampe

[57] ABSTRACT

A support spindle apparatus is inserted into the central aperture of a coreless toilet tissue roll to support the coreless toilet tissue roll in a toilet tissue dispenser cabinet having side walls defining at least one elongated, generally vertically oriented slot. The support spindle apparatus includes a double-ended elongated spindle body frictionally engaged with the toilet tissue roll, a roll stop element fixedly attached to the elongated spindle body to positively prevent movement of the coreless toilet tissue roll relative to the support spindle apparatus in a single axial direction, and an enlargement fixedly attached to the elongated spindle body at one end of the elongated spindle body and having a bearing surface oriented toward the roll stop element.

1 Claim, 2 Drawing Sheets

SUPPORT APPARATUS FOR CORELESS TOILET TISSUE ROLL

TECHNICAL FIELD

This invention relates to apparatus for supporting a coreless toilet tissue roll within a toilet tissue dispenser cabinet. More particularly, the invention encompasses support spindle apparatus for insertion into the central aperture of a coreless toilet tissue roll and utilized to support the coreless toilet tissue roll in a toilet tissue dispenser cabinet of the type having opposed, elongated, generally vertically oriented guide slots.

BACKGROUND ART

It is known to manufacture and commercially make available coreless rolls of toilet tissue, i.e. toilet tissue rolls which do not have a central core of paperboard or the like. In coreless toilet tissue rolls the innermost convolution of the toilet tissue web comprising the roll defines a central aperture which is considerably smaller in cross-section than the central aperture or opening of a core utilized in conventional toilet tissue rolls.

It will be appreciated that a great many dispenser cabinets are in existence which incorporate mechanisms designed and adapted for use with conventional toilet tissue rolls with cores. These include many dispenser cabinets for use in public washrooms and other institutional environs which allow sequential dispensing from a plurality of rolls deployed in the dispenser cabinets.

An example of the latter is the Model B-288 Contura Series toilet tissue dispenser made available by Bobrick Washroom Equipment, Inc. of Los Angeles, Calif. In that dispenser cabinet, a reserve toilet tissue roll with conventional tubular core is held by a spindle in an elevated, non-dispensing position within the dispenser cabinet, the ends of the spindle being located in two opposed, elongated, generally vertically oriented slots formed in the sides of the cabinet. A drop-down mechanism in the dispenser cabinet allows the spare or reserve roll to drop into position for use when the lower roll is used up.

The commercially available toilet tissue dispenser cabinet described above is not suitable for dispensing toilet tissue from coreless rolls nor can the spindles conventionally employed in the dispenser cabinet be inserted into and utilized to support coreless rolls of toilet tissue.

Although coreless roll spindles are known generally, the present invention encompasses support spindle apparatus of a specific construction which can be utilized in conjunction with a toilet tissue dispenser cabinet of the type identified above to retain a coreless toilet tissue roll in reserve or temporary storage position above the roll actually being dispensed for subsequent drop down and usage.

Applicant is aware of the following United States patents which are believed to be representative of the present state of the art in this field: U.S. Pat. No. 4,671,466, issued Jun. 9, 1987, U.S. Pat. No. 4,362,278, issued Dec. 7, 1982, U.S. Pat. No. 5,100,075, issued Mar. 31, 1992, U.S. Pat. No. 5,277,375, issued Jan. 11, 1994, U.S. Pat. No. 4,108,389, issued Aug. 22, 1978, U.S. Pat. No. 3,690,580, issued Sep. 12, 1972, U.S. Pat. No. 2,650,773, issued Sep. 1, 1953, U.S. Pat. No. 2,522,109, issued Sep. 12, 1950, U.S. Pat. No. 1,825,822, issued Oct. 6, 1931, U.S. Pat. No. Des. 340,375, issued Oct. 19, 1993; U.S. Pat. No. Des. 335,410; issued May 11, 1993; and Des. 312,179, issued Nov. 20, 1990. None of these patents disclose support spindle apparatus adapting a conventional multi-roll toilet tissue dispenser used to dispense toilet tissue from rolls having cores for use with coreless toilet tissue rolls.

DISCLOSURE OF INVENTION

The present invention relates to support spindle apparatus for insertion into the central aperture of a coreless toilet tissue roll to support the coreless toilet tissue roll in a toilet tissue dispenser cabinet having side walls defining at least one elongated, generally vertically oriented slot. The coreless toilet tissue roll is comprised of a plurality of toilet tissue web convolutions. The central aperture is defined by the innermost toilet tissue web convolution.

The support spindle apparatus includes a double-ended, elongated spindle body for frictional engagement with the innermost toilet tissue web convolution of a coreless toilet tissue roll to resist axial sliding of the coreless toilet tissue roll relative to the support spindle apparatus.

A roll stop element is fixedly attached to the elongated spindle body and extends outwardly from the elongated spindle body at a location on the elongated spindle body between the ends of the elongated spindle body.

The roll stop element is engageable by an end of a coreless toilet tissue roll on the elongated spindle body to positively prevent movement of the coreless toilet tissue roll relative to the support spindle apparatus in a single axial direction.

An enlargement is fixedly attached to the elongated spindle body at one end of the elongated spindle body. The enlargement is spaced from the roll stop element and has a bearing surface oriented toward the roll stop element.

An extension member is attached to and extends from the end of the elongated spindle body remote from the end of the elongated spindle body having the enlargement fixedly attached thereto. The extension member is substantially coaxial with the elongated spindle body and has a peripheral cross-section smaller than the maximum peripheral cross-section of the elongated spindle body.

Other features, advantages, and objects of the present invention will become apparent with reference to the following description and accompanying drawings.

BEST MODE FOR CARRYING OUT THE INVENTION

Figure 1:
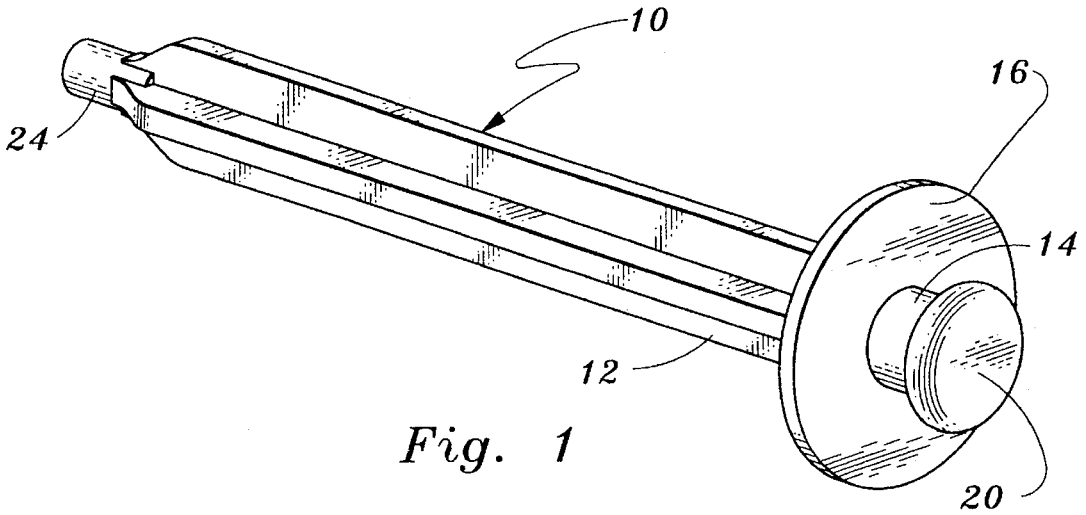
FIG. 1 is a perspective view of support spindle apparatus constructed in accordance with the teachings of the present invention.
Figure 2:
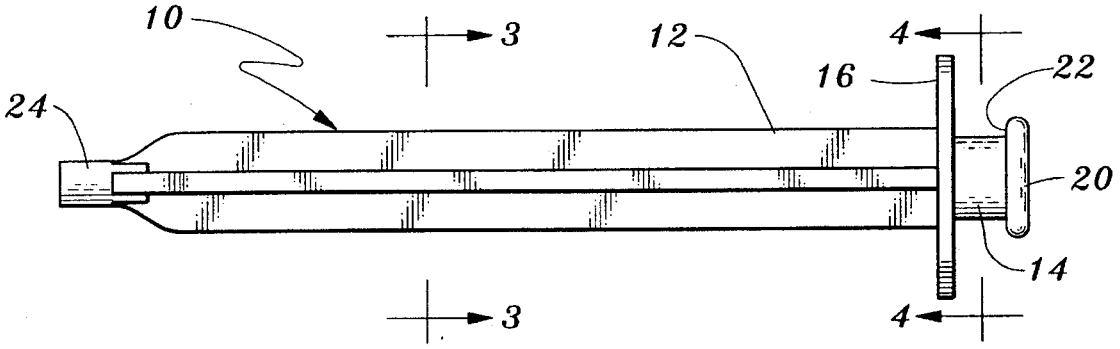
FIG. 2 is a front elevational view of the apparatus.
Figure 3:
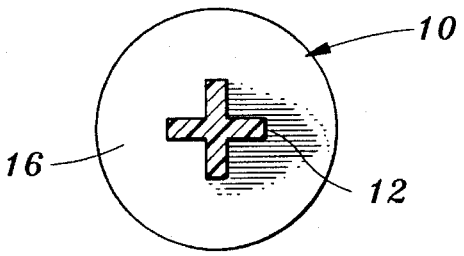
FIG. 3 is an enlarged cross-sectional view taken along the line 3—3 in FIG. 2.
Figure 4:
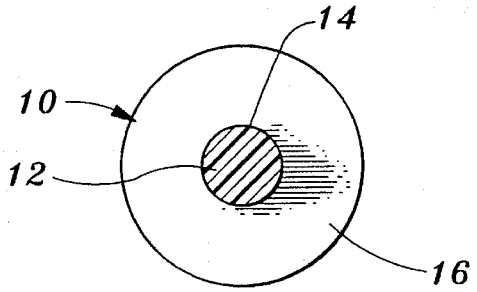
FIG. 4 is an enlarged cross-sectional view taken along the line 4—4 in FIG. 2.

Referring now to the drawings, support spindle apparatus constructed in accordance with the teachings of the present invention is designated by reference numeral 10. Apparatus 10 includes a double-ended, elongated spindle body 12. Elongated body spindle body 12 has a generally cruciform cross-sectional configuration over most of its length and also includes a segment 14 of circular cross-section.

On one side of segment 14 is a roll stop element 16. Roll stop element 16 has a circular configuration in the illustrated embodiment, the roll stop element being fixedly attached to the elongated spindle body and extending outwardly from the elongated spindle body at a location between the elongated spindle body ends.

An enlargement 20 is affixed to the elongated spindle body at an end thereof and adjoins segment 14. The enlargement is a circular-shaped flange radiating outwardly from the elongated spindle body. The enlargement has a bearing surface 22 at the outer periphery thereof oriented toward the roll stop element 16.

At the other end thereof, the support spindle apparatus 10 is tapered. An extension member 24 extends from the elongated spindle body. The extension member is in the form of a boss having a circular cross-sectional configuration and is coaxial with the elongated spindle body. The peripheral cross-section of the extension member is smaller than the maximum peripheral cross-section of the elongated spindle body.

The illustrated support spindle apparatus 10 is preferably of integral, unitary, rigid, molded plastic construction.

Figure 5:
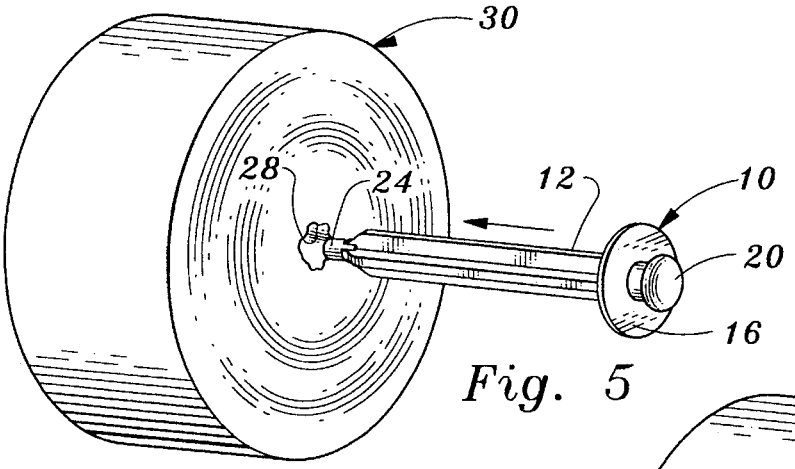
FIG. 5 is a perspective view illustrating the support spindle apparatus being inserted into the central aperture of a coreless toilet tissue roll.
Figure 6:
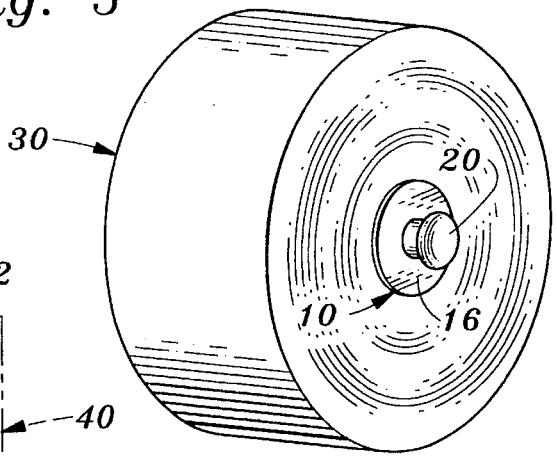
FIG. 6 is a view similar to FIG. 5 but illustrating the support spindle apparatus fully inserted into the coreless toilet tissue roll central aperture.
Figure 8:
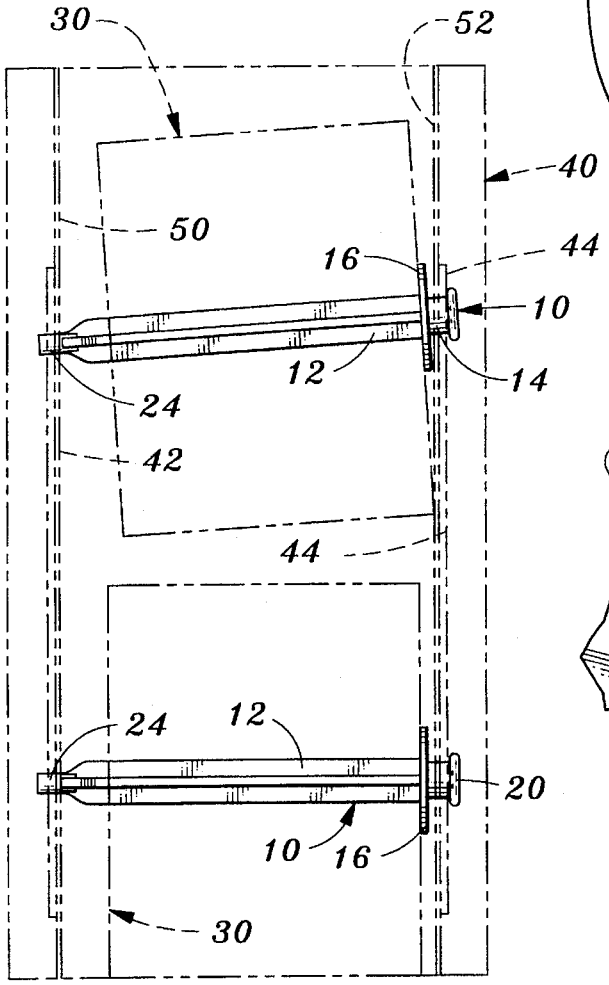
FIG. 8 is a front elevational view illustrating support spindle apparatus mounted at two locations in a toilet tissue dispenser cabinet, the toilet tissue dispenser cabinet and coreless roll associated with the support spindle apparatus being shown by dash lines.

With particular reference to FIGS. 5, 6, and 8, the support spindle apparatus is for insertion into the central aperture 28 of a coreless toilet tissue roll 30, the coreless toilet tissue roll being comprised of a plurality of toilet tissue web convolutions. The central aperture is defined by the innermost toilet tissue web convolution. The aperture 28 is considerably smaller than the central aperture defined by the inner core, typically paperboard, of conventional toilet tissue rolls.

FIG. 5 illustrates the support spindle apparatus 10 just prior to its insertion into aperture 28 of roll 30. The apparatus is inserted with the extension member 24 initially entering the aperture. The individual inserting the apparatus continues to push same into the aperture until the side of the roll abuts roll stop element 16. This is shown in FIG. 6.

The tapering of the lead end of the elongated spindle body facilitates this operation.

The frictional engagement between the elongated spindle body with the innermost toilet tissue web convolution of the roll will resist axial sliding movement of the coreless toilet tissue roll relative to the support spindle apparatus. The roll stop element will positively prevent movement of the coreless toilet tissue roll relative to the support spindle apparatus in one axial direction, i.e. to the right as view in FIGS. 5, 6, and 8.

Once the roll 30 has been placed onto the support spindle apparatus, the end of the apparatus with the extension member 24 will project beyond the other side of the roll, i.e. beyond the left hand side as viewed in FIG. 8.

Figure 7:
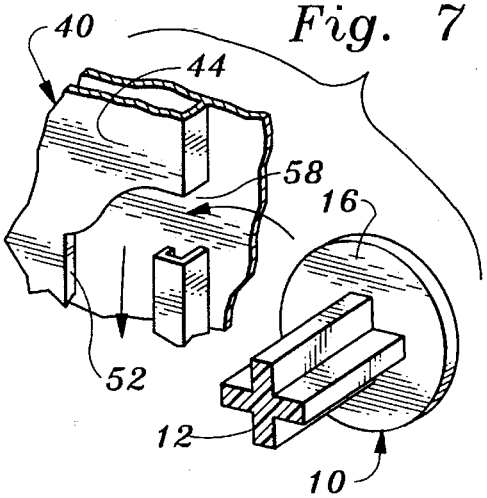
FIG. 7 is a perspective, sectional view illustrating a segment of the support spindle apparatus and a segment of a dispenser cabinet just prior to installation of the support spindle apparatus on the dispenser cabinet.

Now the support spindle apparatus with roll thereon is positioned in the interior of a toilet tissue dispenser cabinet 40 (FIGS. 7 and 8). For purposes of illustration, it will be assumed that dispenser cabinet 40 is the Bobrick Contura Series Model B-288 referenced above. Such dispenser cabinet includes two side walls 42, 44, each of which defines an elongated, generally vertically oriented slot. The slot defined by wall 42 is defined by reference numeral 50 and the slot defined by wall 44 is identified by reference numeral 52. Slot 50 is meant to accommodate extension member 24 while slot 52 accommodates segment 14 of the elongated spindle body.

In FIG. 8, two rolls 30, each mounted on a support spindle apparatus 10, are disposed in the interior of the dispenser cabinet 40. Access to the interior of the dispenser cabinet is had through a cover (not shown) which can be locked or unlocked to control access to the interior.

FIG. 8 shows the lowermost roll 30 in a dispensing position near the bottom end of the dispenser cabinet. Suitable mechanism incorporated in the dispenser cabinet retains the roll in such position. Such mechanism has not been illustrated since it is well known in the prior art and does not form a part of the present invention. However, reference may be had to the above-identified representative dispenser cabinet for an example of such a mechanism.

The uppermost apparatus 10 is disposed on an incline with the roll and apparatus cooperable with the dispenser cabinet to maintain the uppermost roll in an elevated or reserve position.

FIG. 7 shows an end of the support spindle apparatus 10 just prior to placement in slot 52 through an access opening 58 communicating with the slot. The other end of the support spindle apparatus 10, i.e. the projection or extension member 24 is placed in slot 50; however, there is no support provided in the dispenser cabinet for supporting the extension member 24 against downward movement. Thus, the support spindle apparatus 10 will drop downwardly at that end so that the support spindle apparatus and the roll 30 thereon are disposed at an incline as shown in FIG. 8. Downward movement of extension member 24 will stop when the bearing surface 22 on enlargement 20 engages the side wall 44 and when the end of the roll nearest side wall 44 engages same at the bottom of the roll.

This position is shown in FIG. 8 with respect to the topmost support spindle apparatus. Such frictional engagement will prevent the topmost support spindle apparatus 10 and roll 30 thereabout from moving downwardly within the cabinet under the influence of gravity until the drop-down mechanism incorporated in the dispenser cabinet (not shown) is triggered by depletion of the lowermost roll.

In order to accomplish such result, the roll stop element and the enlargement are spaced apart a distance greater than the thickness of the side wall 44 defining the slot 52.

I claim:

1. In combination:

a toilet tissue dispenser cabinet defining a cabinet interior and having spaced side walls defining opposed, generally vertically oriented, elongated slots;

a coreless toilet tissue roll comprised of a plurality of toilet tissue web convolutions and having a central aperture defined by the innermost toilet tissue web convolution; and support spindle apparatus including a double-ended elongated spindle body positioned in the central aperture of said coreless toilet tissue roll and having an outer peripheral surface in tight frictional engagement with the innermost toilet tissue web convolution of the coreless toilet tissue roll to resist sliding of the coreless toilet tissue roll relative to said support spindle apparatus in an axial direction, a roll stop element fixedly attached to said elongated spindle body and extending outwardly from said elongated spindle body at a location on said elongated spindle body between the ends of the elongated spindle body, said roll stop element abutting against an end of the coreless toilet tissue roll to positively prevent movement of the coreless toilet tissue roll relative to the support spindle apparatus in a single axial direction, an enlargement fixedly attached to the elongated spindle body at an end of the elongated spindle body, the enlargement being spaced from the roll stop element and having a bearing surface oriented toward said roll stop element, said elongated spindle body being located in one of the slots of the toilet tissue dispenser cabinet with the roll stop element being located on one side of the wall defining the slot within which the elongated spindle body is located and the enlargement located on the other side of the wall defining the slot within which the elongated spindle body is located, said support spindle apparatus being tiltably disposed within the cabinet interior with said enlargement bearing surface and said coreless toilet tissue roll both in engagement with said toilet tissue dispenser cabinet to resist downward movement of the support spindle apparatus and coreless toilet tissue roll within the toilet tissue dispenser cabinet under the influence of gravity, said enlargement comprising a circular-shaped flange radiating outwardly from said elongated spindle body and said elongated spindle body having a circular-shaped cross-section between said roll stop element and said enlargement, said support spindle apparatus additionally comprising an extension member attached to the end of said elongated spindle body remote from said enlargement, said extension member being substantially coaxial with said elongated spindle body and having a peripheral cross-section smaller than the maximum peripheral cross-section of said elongated spindle body, said extension member being unsupported and projecting into the slot opposed to the slot in which the elongated spindle body is located, the maximum cross-sectional dimension of said extension member being smaller than the slot into which the extension member projects, and said roll stop element and said enlargement being spaced apart a distance greater than the thickness of the side wall defining the slot within which said elongated spindle body is located.

* * * * *